US009604376B2

(12) United States Patent
Sacks et al.

(10) Patent No.: US 9,604,376 B2
(45) Date of Patent: Mar. 28, 2017

(54) PERSONAL GROOMING ASSISTANT

(71) Applicant: Skyworld Innovations, LLC, Garland, TX (US)

(72) Inventors: Jeff Sacks, Plano, TX (US); James J. Smith, Garland, TX (US); Kathryn A. Wilkinson-Smith, Garland, TX (US)

(73) Assignee: SKYWORLD INNOVATIONS, LLC, Garland, TX (US)

( * ) Notice: Subject to any disclaimer, the term of this patent is extended or adjusted under 35 U.S.C. 154(b) by 0 days.

(21) Appl. No.: 14/880,968

(22) Filed: Oct. 12, 2015

(65) Prior Publication Data

US 2016/0031102 A1 Feb. 4, 2016

Related U.S. Application Data

(63) Continuation-in-part of application No. 29/475,631, filed on Dec. 4, 2013, now Pat. No. Des. 741,015.

(51) Int. Cl.

| | |
|---|---|
| ***B26B 21/52*** | (2006.01) |
| ***A46B 17/02*** | (2006.01) |
| ***B25G 1/04*** | (2006.01) |
| ***B25G 3/02*** | (2006.01) |
| ***B25G 3/38*** | (2006.01) |
| ***B25G 1/06*** | (2006.01) |

(52) U.S. Cl.

CPC ..... *B26B 21/523* (2013.01); *A46B 17/02* (2013.01); *B25G 1/04* (2013.01); *B25G 1/06* (2013.01); *B25G 3/02* (2013.01); *B25G 3/38* (2013.01); *A46B 2200/1066* (2013.01); *Y10T 16/469* (2015.01); *Y10T 16/4719* (2015.01)

(58) Field of Classification Search

CPC ..... B26B 21/523; A46B 17/02; B25G 1/04; B25G 1/06; B25G 3/02; B25G 3/38; Y10T 16/469; Y10T 16/4719

See application file for complete search history.

(56) References Cited

U.S. PATENT DOCUMENTS

| | | | | |
|---|---|---|---|---|
| 4,037,322 | A | 7/1977 | Bresler | |
| 4,905,372 | A * | 3/1990 | Willis | B26B 21/523 30/526 |
| D325,689 | S * | 4/1992 | Gray | D28/48 |
| 5,167,069 | A * | 12/1992 | Quinn | B26B 21/523 30/527 |
| 5,729,865 | A * | 3/1998 | Stoddart | B05C 17/0205 16/429 |
| 5,810,408 | A * | 9/1998 | Armstrong | A01B 1/00 16/422 |

(Continued)

*Primary Examiner* — Jeffrey O Brien

(57) ABSTRACT

Disclosed herein are various embodiments and variations of a personal grooming device extender. In one embodiment, a personal grooming device extender comprises a telescoping handle having a proximal end and a distal end, and a top side and a bottom side; and an arm pivotably coupled with the distal end of the telescoping handle, the arm configured to adjust to a plurality of positions between a first position, extended linearly from the handle and a second position perpendicular with the distal end of the handle. A receiver may be releasably coupled onto the arm, the receiver comprising a moveable holding member configured to receive and hold a grooming tool. In some embodiments, the receiver may be interchangeable to accommodate a wider variety of grooming tools.

17 Claims, 7 Drawing Sheets

(56) References Cited

U.S. PATENT DOCUMENTS 5,816,337 A * 10/1998 Kun-Chuan ..... A01B 1/222 16/422
6,189,222 B1 * 2/2001 Doyle ..... B26B 21/523 15/144.1
6,263,821 B1 * 7/2001 Hodder ..... A46B 17/02 114/222
6,266,888 B1 * 7/2001 Zowaski ..... B26B 21/523 30/526
D472,673 S 4/2003 Carvotta et al.
6,883,208 B1 * 4/2005 Huang ..... B25G 1/04 16/110.1
D507,379 S 7/2005 Alphonso
6,915,580 B2 7/2005 Dassel
7,028,407 B2 4/2006 Ehrlich et al.
7,103,980 B2 * 9/2006 Leventhal ..... B26B 19/10 30/211
D560,032 S * 1/2008 Lopez ..... D28/48
D563,047 S * 2/2008 Ramm ..... D28/48
7,694,392 B2 * 4/2010 Touchette ..... B25D 1/14 16/430
7,726,032 B1 * 6/2010 Hernandez ..... B26B 21/523 30/334
7,856,725 B2 * 12/2010 Marut ..... B26B 21/523 30/527
8,006,393 B2 * 8/2011 Collins ..... B26B 21/523 30/526
8,550,437 B2 * 10/2013 Liou ..... B25F 1/00 254/115
8,683,657 B2 * 4/2014 Lin ..... B25G 1/04 16/426
8,720,072 B2 * 5/2014 Bucco ..... B26B 21/522 30/32
8,959,698 B2 * 2/2015 Prosser ..... B25G 3/38 15/144.1
D741,015 S * 10/2015 Sacks ..... D28/48
9,364,948 B1 * 6/2016 Rudnick ..... B25G 3/38
2003/0177648 A1 * 9/2003 Zeiter ..... B26B 21/523 30/526
2003/0208914 A1 11/2003 Ehrlich et al.
2004/0107585 A1 * 6/2004 Helmrich ..... B26B 19/38 30/537
2004/0194325 A1 10/2004 Ehrlich et al.
2006/0101655 A1 * 5/2006 Givant ..... B26B 21/523 30/523
2007/0119059 A1 5/2007 Leventhal
2007/0227015 A1 * 10/2007 Collins ..... B26B 21/523 30/526
2008/0110025 A1 * 5/2008 Bucalo ..... B26B 19/38 30/43.1
2011/0094114 A1 * 4/2011 Payne-Baggetta .... B26B 21/523 30/526
2015/0007404 A1 * 1/2015 Prosser ..... B25G 3/38 15/144.1
2015/0224657 A1 * 8/2015 Bolcar ..... B26B 21/523 30/541
2016/0096280 A1 * 4/2016 Robertson ..... B26B 21/523 30/53

* cited by examiner

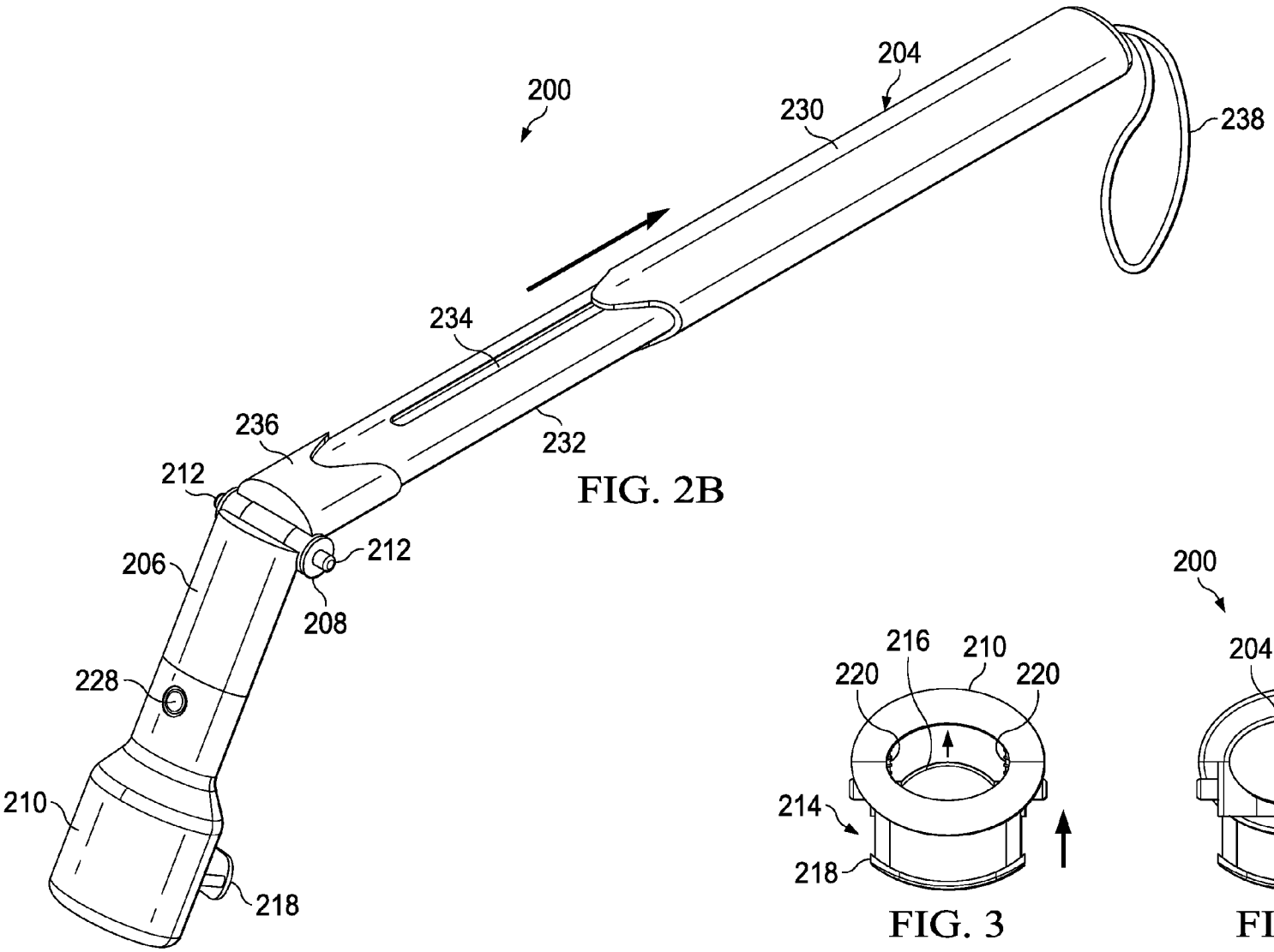
FIG. 2B
FIG. 3
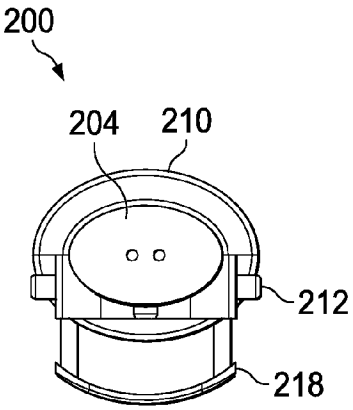
FIG. 4

PERSONAL GROOMING ASSISTANT

CLAIM OF PRIORITY

This patent application is a continuation in part of application Ser. No. 29/475,631, filed on Dec. 4, 2013 by inventors Jeff Sacks and James J. Smith, entitled "PERSONAL GROOMING ASSISTANT," the entire contents of which are incorporated herein by reference.

TECHNICAL FIELD

The present disclosure is directed, in general, to a personal grooming device extender and, more specifically, to a personal grooming device extender configured to receive and hold varying sizes of grooming tools, such as, e.g., razors, to assist in grooming otherwise inaccessible or hard to reach parts of the human body.

BACKGROUND

Conventional shaving razors are commonly used by both male and female consumers for shaving various body parts such as the face and legs. Modern grooming currently may emphasize a broader, "clean-shaven" appearance for many men in a variety of occupations, including models, body builders, actors, and various other professions where personal grooming and body appearance may be highly valued. Conventional shaving razors are limited in their range because a traditional razor handle is designed to fit within the palm of the user's hand/fingers, such that the razor handle does not extend the reach of the individual razor head much beyond the reach of the user's hands. As a result, using such razors to reach remote locations of the body, such as the legs and the back, for example, can be difficult and uncomfortable, and is especially difficult for a user with physical disability, who is overweight, or in the case of women, who is pregnant.

SUMMARY

Disclosed herein are various embodiments and aspects of personal grooming device extenders. In one embodiment, there is disclosed a personal grooming device extender comprising a telescoping handle having a proximal end and a distal end, and a top side and a bottom side; an arm pivotably coupled with the distal end of the telescoping handle, the arm configured to adjust to a plurality of positions between a first position, extended linearly from the handle and a second position perpendicular with the distal end of the handle; and a receiver releasably coupled onto the arm, the receiver comprising a moveable holding member configured to receive and hold grooming tools of various sizes.

In another embodiment, a personal grooming apparatus comprises a telescoping handle having a proximal end and a distal end, and a top side and a bottom side; wherein the telescoping handle is configured to telescope from a first position to a plurality of extended positions; and an arm pivotably coupled with the distal end of the telescoping handle, the arm configured to adjust to a plurality of positions between a first position, extended linearly from the handle and a second position perpendicular with the distal end of the handle. A receiver may be releasably coupled onto the arm, the receiver comprising a moveable holding member configured to receive and hold grooming tools of various sizes, wherein at least a portion of the moveable holding member extends externally from the receiver.

In yet another embodiment, a personal grooming system, comprises a telescoping handle. The telescoping handle comprises a proximal end and a distal end; a top side and a bottom side; an inner sleeve; and an outer sleeve slideably fitted over the inner sleeve; wherein the telescoping handle is configured to telescope from a first position to a plurality of extended positions. The personal grooming system further comprises an arm pivotably coupled with the distal end of the telescoping handle, the arm configured to adjust to a plurality of positions between a first position, extended linearly from the handle and a second position perpendicular with the distal end of the handle; and a receiver releasably coupled onto the arm, the receiver comprising a spring-loaded moveable holding member configured to receive and hold grooming tools of various sizes, wherein at least a portion of the moveable holding member extends externally from the receiver.

BRIEF DESCRIPTION OF THE DRAWINGS

For a more complete understanding of the present disclosure, reference is now made to the following descriptions taken in conjunction with the accompanying drawings, in which:

FIG. 2B is an isometric view of the personal grooming device extender of FIG. 2A having a handle in a telescoped position;

FIG. 3 is a front end view of the personal grooming tool shown in FIG. 2A, showing a movable holding member at one end thereof;

FIG. 4 is a back end view of the personal grooming tool shown in FIG. 2A;

DETAILED DESCRIPTION

Traditional shaving razors are designed and intended for use on the face. Women use razors for shaving other parts of the body such as legs and under arms, inter alia. Men also use razors for shaving other areas of the body, including the back, shoulders, and legs (such as, for example a swimmer or other athletes), inter alia. Certain handle extenders have been tried to extend the reach and range of a traditional razor but have various flaws, including only providing a one dimensional or one-directional extension, or limited only to only a certain type of razor or handle.

Previous attempts have been made to solve the limited range and reach of traditional razors. Some attempts have included razors having extra-long handles, or have an extender coming from one end. Others include handles that attach onto a razor, or receive a razor at one end having an opening with retaining flanges, or flexible retaining heads, or a tightening screw to hold a razor in place. However none have been able to receive different types and sizes of razors, nor included a telescoping handle, nor provided a change of angle for the razor.

The present disclosure provides embodiments of a personal grooming device extender which solves at least the foregoing problems. Embodiments of the grooming device extender include telescoping and adjustable handles, one or more adjustable and bendable components, and the ability to receive a variety of sizes, shapes, and types, or razors. The combination of the components and features of the personal grooming device extender has proven to be a successful, sought after personal grooming accessory which can be used by users of all types, shapes, and sizes, for shaving various areas of the body without bending or contorting in uncomfortable or unsafe ways, and has been especially successful with women due to the ability to shave hard to reach places, such as legs, without having to bend over. Various embodiments and improvements may also be particularly useful to persons having limited range of motion due to a physical disability, whether temporary or permanent.

Figure 1:
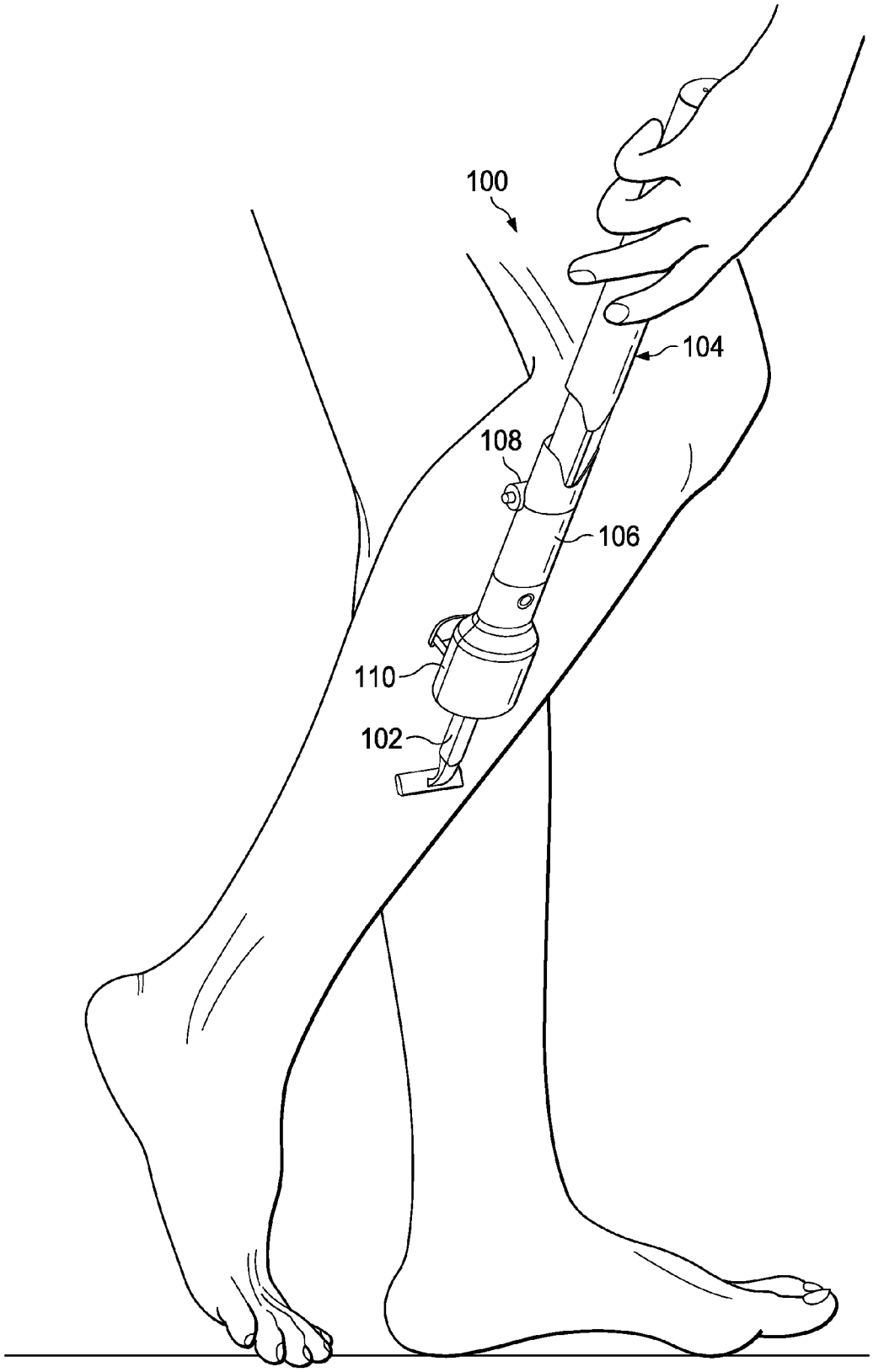
FIG. 1 is an environmental view of one embodiment of a personal grooming device extender according to the present disclosure.

Referring now to FIG. 1, there is shown a personal grooming device extender 100 according to the present disclosure having a razor 102 being held therein. The device extender 100 comprises a telescoping handle 104 having a proximal and distal end. Coupled with the distal end of the handle 104 is an arm 106. The arm 106 may be coupled to the handle 104 via a pivot hinge 208 such that the arm 106 is configured to pivot and adjust between a plurality of angular positions with respect to the distal end of the handle 104. Coupled onto the arm 106 is a receiver 110 into which the razor 102 or other grooming tool may be inserted and held therein. The handle 104 may telescope to a plurality of positions to enable a user to more easily reach remote or hard to reach places on the body with the razor or other personal grooming tool, such as, for example, the lower portions of legs as shown. Likewise, adjusting the angular position of the arm 106 further extends the range of motion for the razor 102. For example, if a user is shaving his back, he may need to extend the handle to a longer length and adjust the arm angularly to better reach certain areas of his back.

Figure 2A:
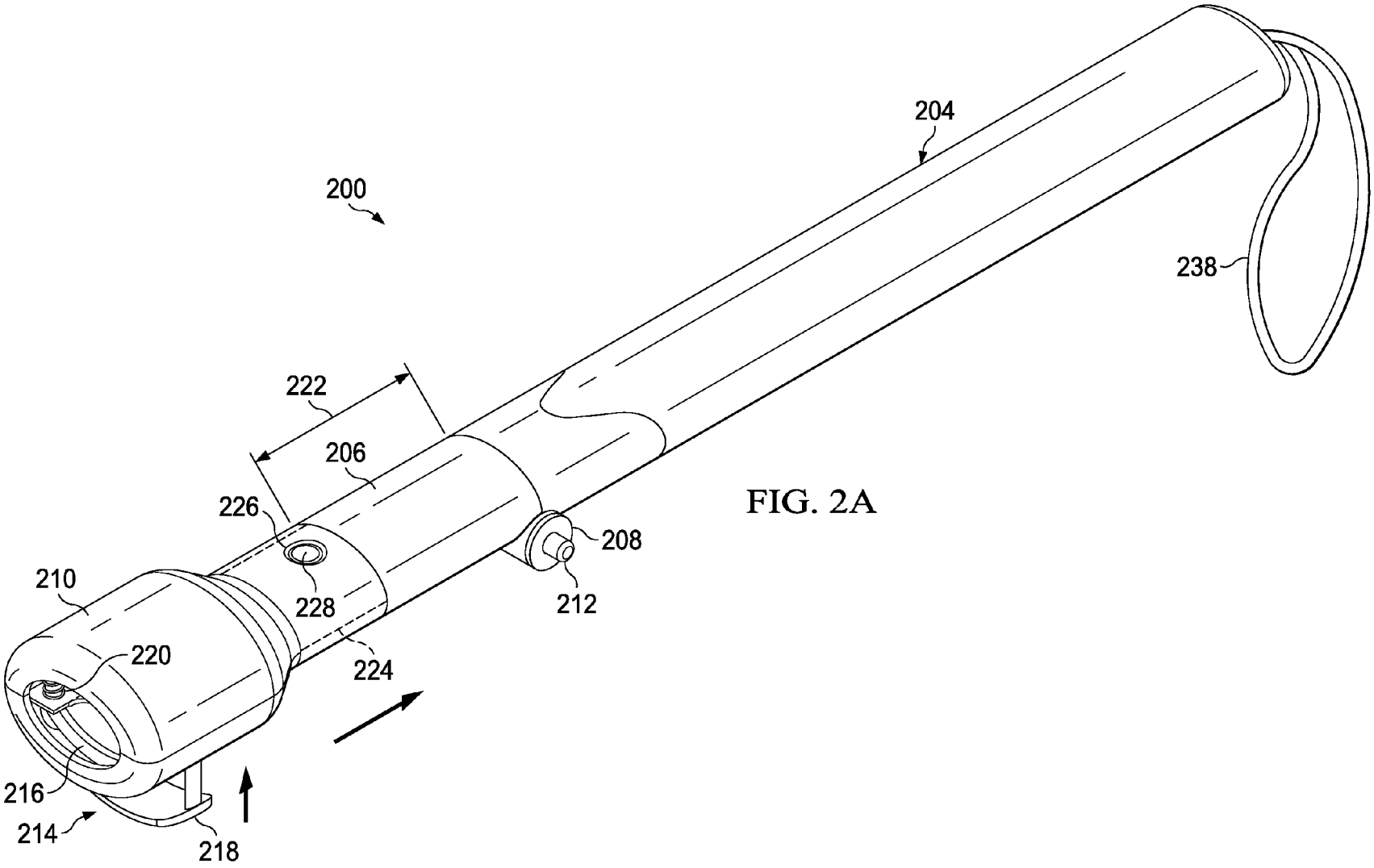
FIG. 2A is an isometric view of another embodiment of a personal grooming device extender.

Referring initially to FIG. 2A, illustrated is an isometric view of one embodiment of a personal grooming device extender 200 constructed according to the principles of the present invention. The device extender 200 comprises a telescoping handle 204 having a proximal and distal end. Coupled onto the distal end of the handle 204 is arm 206. The arm 206 may be coupled via a hinge 208 such that the arm 206 may pivot and be adjusted between an initial position, linear with the handle 204, to a fully deployed position, about perpendicular with the distal end of the handle 204. The arm 206 may also be adjusted to various positions at various angles between the initial (o degrees) position and the deployed positions (90 degrees). To adjust the position of the arm 206, a user presses hinge pins 212 on each side of the hinge 208 while moving the arm 206, and then when the arm 206 is in the desired position, the user then releases the pins 212 to lock the arm 206 into the desired position.

Releasably coupled onto the distal end of the arm 206 is receiver 210 for receiving and holding a personal grooming tool therein, such as, for example, a razor, brush, trimmer, toothbrush, back scratcher, and various other generally handheld personal grooming tools. The receiver 210 comprises a moveable holding member 214 configured to receive and hold a grooming tool. The holding member 214 comprises a holding bar 216 positioned within the receiver 210, which may be coupled to an external bar 218 which the user presses inward toward the receiver 210 to create a wider opening while the grooming tool, such as razor 102, is inserted into the receiver 210. To secure the grooming tool into a held position, the user releases the external bar 218 and the holding bar 216 then secures down onto the handle of the grooming tool. The holding bar 216 may be spring-loaded and held in place by two or more springs 220 positioned between the holding bar 216 and the inner surface of the receiver. In other embodiments, the holding member 214 may further comprise a locking screw or pin which may be releasable by engaging the external bar 218. Accordingly, the holding member 214 may be adjustable to accommodate various handle sizes of grooming tools, from manual razors which may be small, to the electric or battery operated power razors such as, e.g., the Gillette® Mach3® and similar razors. Likewise, brush handles and toothbrush handles may be held in the receiver 210, enabling users having physical limitations, for example, to more easily use a brush or toothbrush without lifting their arms much, if at all.

The receiver 210 may be releasably coupled onto the arm 206 such that different sizes and configurations of receivers may be used with the device extender 200, and also to accommodate different attachments, such as, e.g., a trimmer, back scratcher, or various other attachments that may be configured to attach onto the arm 206. The arm 206 may be configured having a wide base 222 and a narrow end 224 such that the received slides onto the narrow end 224. The receiver 210 secures into place once an opening 226 of the receiver 210 fits onto a protruding button 228 on the narrow end 224. To release and change the receiver 210, the user presses down on the protruding button 228 and slides the receiver 210 off of the arm 206. In alternate embodiments, the receiver 210 may fit on to the 206 arm via a snap fit, tension fit, and other suitable attachment methods known to those skilled in the art.

Referring now to FIG. 2B, there is shown the device extender 200 having the handle 204 in a telescoped position and the arm 206 deployed at an angle. The handle 204 may comprise an outer sleeve 230 that fits over and slides along an inner sleeve 232. The inner sleeve 232 comprises a sliding track 234 having stops along which the outer sleeve may slide and stop at various positions for various lengths. In some embodiments, an end cap 236 may be positioned at the distal end of the handle 204 and the inner sleeve 232 may couple with or be slideably coupled into the end cap 236. In some embodiments, the end cap 236 and inner sleeve 232 may comprise one fluid component, and may be fabricated using an injection molding process, or other suitable process for forming plastics or metals into shaped components. In alternate embodiments, the outer sleeve 230 and inner sleeve 232 may fit together via a tension fit, twist fit, or other adjustable fit known to those skilled in the art.

In some embodiments, a wrist-strap 238 may be attached to the handle 204 at the proximal end thereof. In some embodiments, the outer sleeve 230 may comprise rubber or soft polymer, or may have a rubber or soft and flexible coating around the outer sleeve 230 such that the handle 204 is easier to grip and hold, especially given that the extender 200 may likely be used in or around water, such as in or around a shower.

Most of the components of the device extender may comprise plastics, polymers, vinyls, polyvinyl chloride (PVC), metals, or any material that is sturdy and strong, yet light enough in weight for manipulation and also capable of withstanding frequent use and compatibility with wet areas, such as bathrooms, and similar areas. Some of the components, such as the handle 204 and the wide base 222 of arm 206 may comprise rubber or non-slip coatings, or comprise a combination of polymers and non-skid materials.

Referring now to FIG. 3, there is shown an end view of the device extender 200, with the arm 206 positioned linearly with the handle 204. As shown, the external bar 218 is pressed down towards the receiver 210, compressing springs 220 and moving the holding bar 216 to enlarge the opening of the receiver for receiving a grooming tool handle. Once the grooming tool handle is placed into the receiver 210, the external bar 218 is released and the holding bar 216 closes downward and the springs 220 maintain pressure on the holding bar 216. While the extender 200 is shown in FIG. 2-9 having a spring loaded locking mechanism 214, other embodiments may utilize a locking pin, tension pin, or other locking means used to hold a holding bar 216 in place and maintain pressure on a grooming tool handle placed and held within the receiver 210.

Referring now to FIG. 4, there is shown the opposing end of the extender 200, the distal end of the handle 204. The distal end of the handle 204 may comprise openings 240 for threading a strap such as wrist-strap 236 there through.

Figure 5:
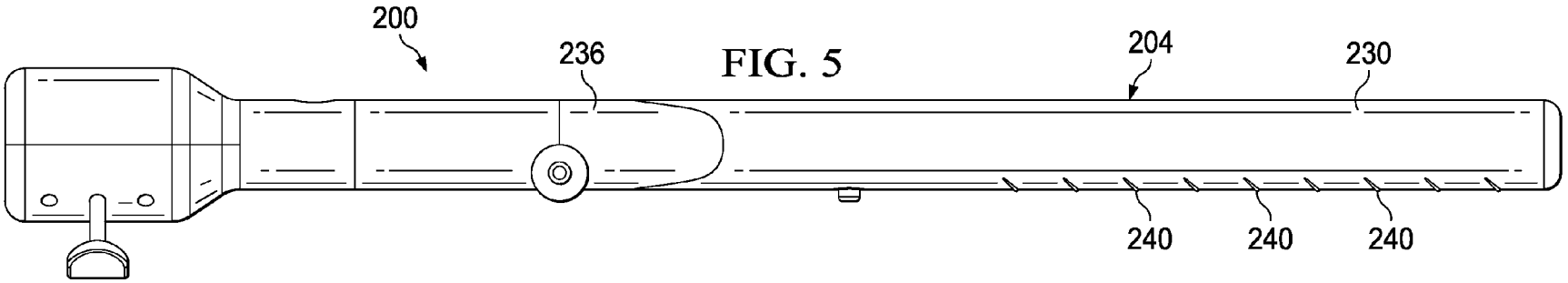
FIG. 5 is a right side view of the personal grooming tool shown in FIG. 2A.
Figure 6:
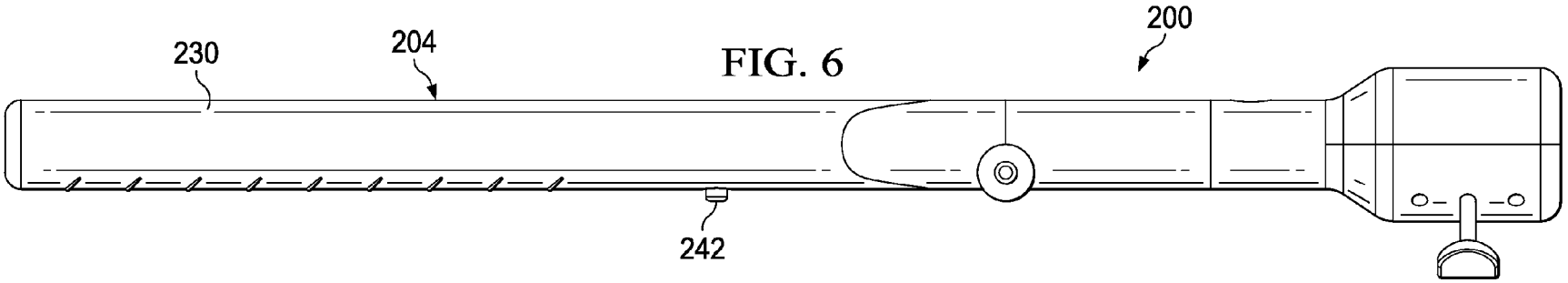
FIG. 6 is a left side view of the personal grooming tool shown in FIG. 2A.

Referring now to FIGS. 5 and 6, there are shown both right side and left side views of the device extender 200. The handle 204 may comprise a plurality of grips 240 positioned along a bottom side of the outer sleeve 230. The grips 240, in addition to a rubber or slip-resistant polymer coating around the outer sleeve 230 enable a user to more easily hold the device extender in a stable position without slipping and other hazards that may arise when used around water and also along with gels or creams which may be used for shaving or grooming.

Figure 7:
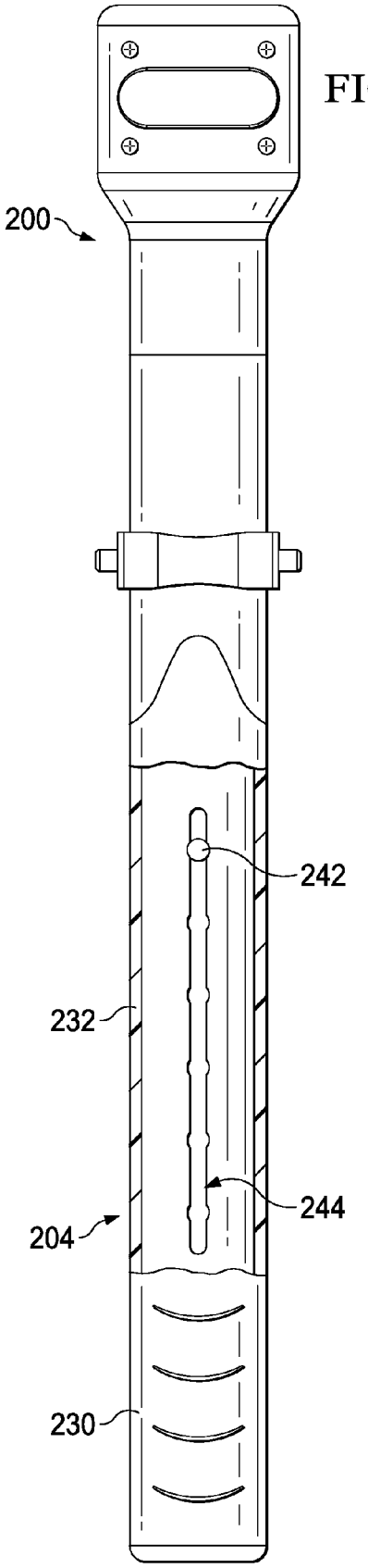
FIG. 7 is a bottom view of the personal grooming tool shown in FIG. 2A, showing various telescoping positions of the handle.

Referring to FIGS. 6 and 7, there is shown a bottom sliding track 244 which is positioned in a mirrored position with sliding track 234 along the inner sleeve 232. The outer sleeve 230 may comprise a button 242 positioned which extends inward from the outer sleeve and may be locked in one of a plurality locking stops 246 along the bottom sliding track 244. Accordingly, a user may push in the button 242 while moving the outer sleeve either away from or towards the distal end of the handle 204 in order to adjust the overall length of the device extender 200.

Figure 8:
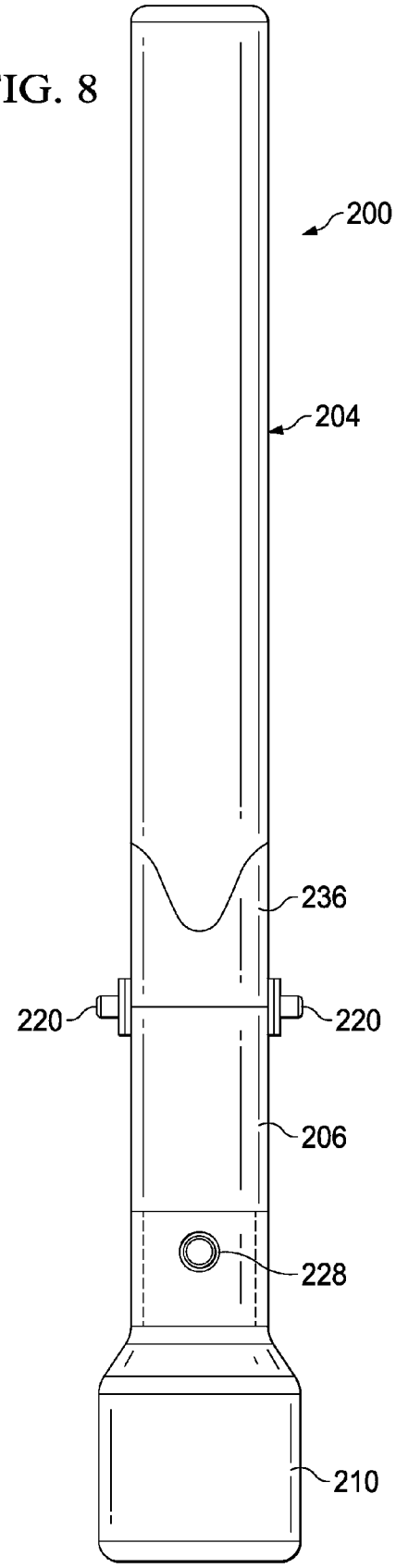
FIG. 8 is a top view and partial section view of the personal grooming tool shown in FIG. 2A.
Figure 9:
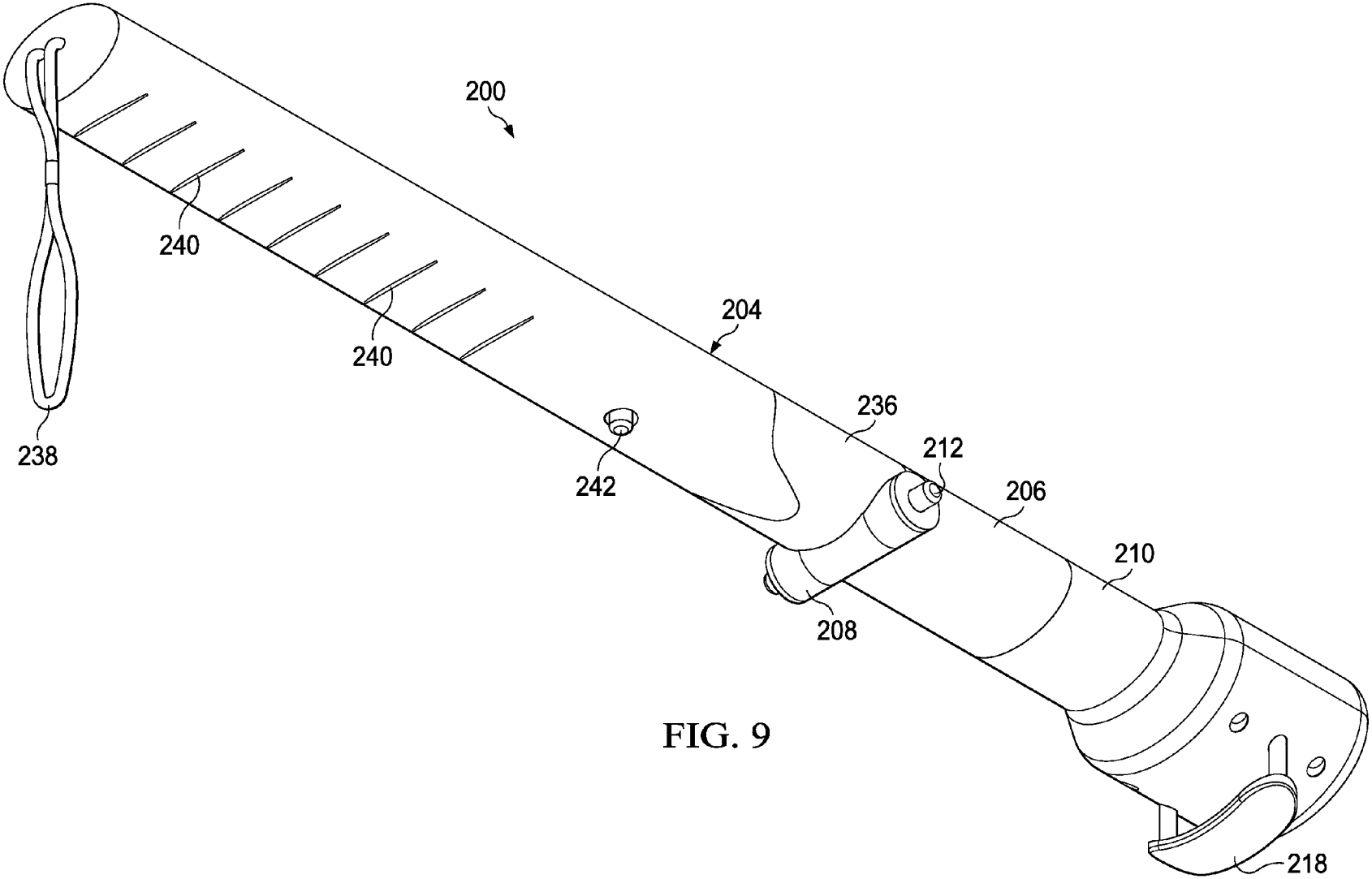
FIG. 9 is an alternate isometric view of the personal grooming tool shown in FIG. 2A.

Referring to FIG. 8, there is shown a top view of the device extender 200 shown in an un-extended position, illustrating the components found along the top side. Referring to FIG. 9, there is shown a bottom perspective view of the device extender 200 illustrating the components found along the bottom side.

Figure 10:
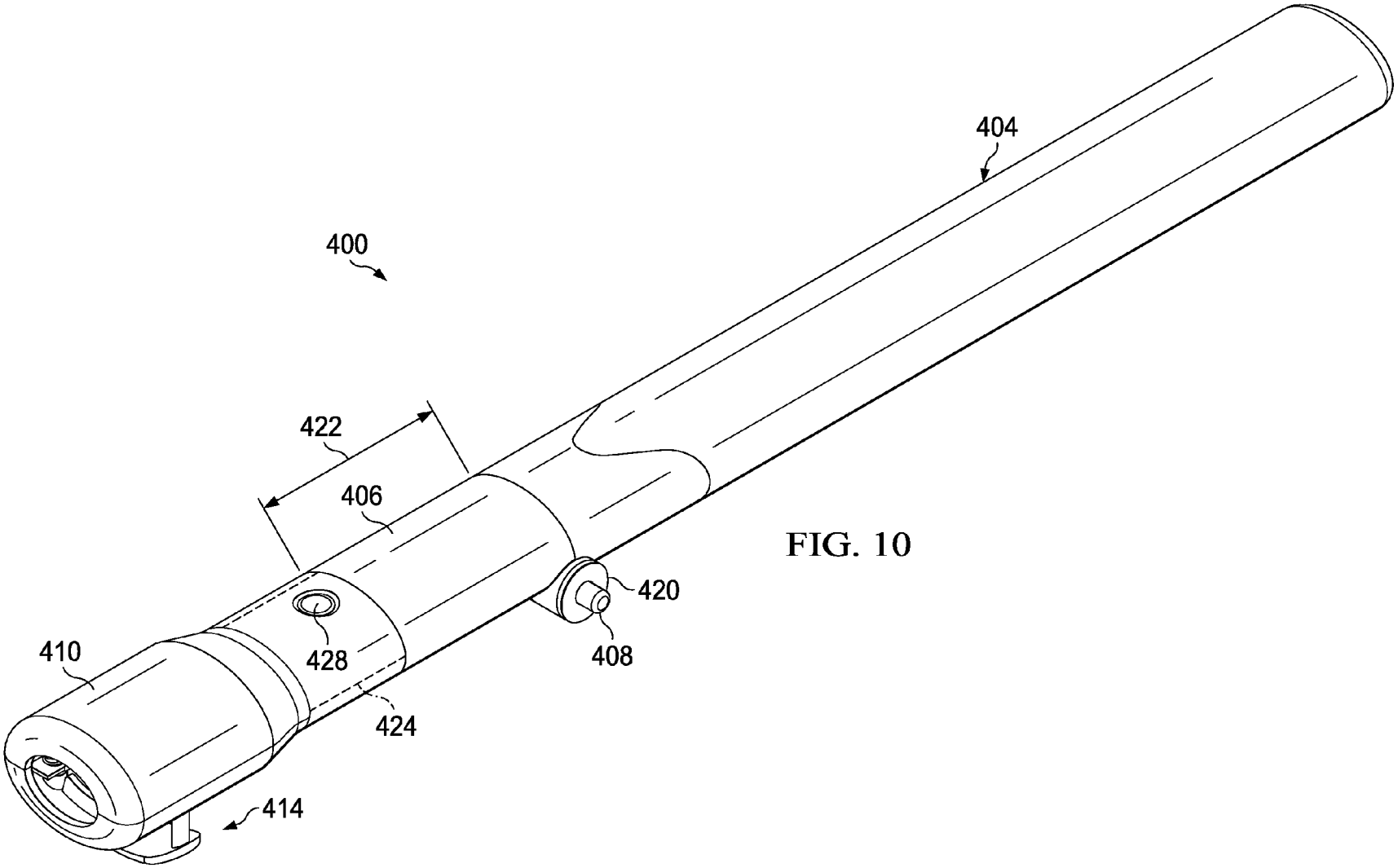
FIG. 10 is a perspective view of an alternate embodiment of a personal grooming tool according to the present disclosure.

Referring now to FIG. 10, there is shown a perspective view of another embodiment of a device extender 400 according to the present disclosure. The device extender 400 may be constructed similarly to device extender 200 and comprise similar components, including a handle 404 having a proximal end and a distal end. The device extender may similarly comprise an arm 406 hingedly coupled to the distal end of the handle 404 via a pivot 408. The arm may similarly be configured to pivot and be adjusted between an initial position, linear with the handle 404, to a fully deployed position, about perpendicular with the distal end of the handle 404. The arm 406 may also be adjusted to various positions at various angles between the initial (o degrees) position and the deployed positions (90 degrees) via pins 412 which when depressed, allow the arm to pivot about the distal end of the handle 404 and adjust to various angular positions therewith.

Device extender 400 may comprise a different receiver 410 than receiver 210, which may be used for grooming tools having smaller handles, such as disposable razors, pick combs, and similar small handles grooming tools. The receiver 410 may be coupled onto the arm 406 in a similar fashion with a protruding button 428 that when depressed, allows the user to slide the receiver 410 one and off of the arm 406, and as such, various receiver attachments.

In other embodiments, the handle may comprise additional sections for longer length extensions. Similarly, the handle may comprise multiple sections that may each telescope and hingedly couple with each other for an even greater angular adjustment range. In additional embodiments, the device extender may comprise grooming attachments such as, for example, back scratchers and trimmers that may be received and held in the receiver. In some embodiments, the grooming attachments may be configured to coupled directly onto the arm in place of the receiver. Other attachments, such as mirrors, for example, may be attached onto the handle for visibility of the area being groomed.

In some embodiments, the proximal end of the device extender may be adapted to receive additional tools. For example, the outer sleeve may comprise a receiver adapted to receive snap on tools such as, e.g., a comb, trimmer, mirror, and various other tools that may be adapted to snap on or attach to the proximal end of the handle. In other embodiments, the proximal end of the handle may comprise a received, similar to receiver 210, which may be configured to receive and hold various grooming tools of various sizes.

The embodiments disclosed are illustrative rather than limiting in nature and that a wide range of variations, modifications, changes, and substitutions are contemplated in the foregoing disclosure and, in some instances, some features of the present invention may be employed without a corresponding use of the other features and without departing from the spirit and scope of the invention in its broadest form. Many such variations and modifications may be considered desirable by those skilled in the art based upon a review of the foregoing description of various embodiments.

The invention claimed is:

1. A personal grooming device extender, comprising:

a telescoping handle having a proximal end and a distal end, and a top side and a bottom side;

an arm pivotably coupled with the distal end of the telescoping handle, the arm configured to adjust to a plurality of positions between a first position, extended linearly from the handle and a second position perpendicular with the distal end of the handle; and a receiver releasably coupled onto the arm, the receiver comprising a moveable holding member configured to receive and hold grooming tools of various sizes;

wherein at least a portion of the moveable holding member extends externally from the receiver;

wherein the moveable holding member is spring-loaded by at least one spring;

wherein the portion of the moveable holding member that extends externally is configured to be pressed to compress the at least one spring for creating a wide opening for receiving the grooming tool and when the portion is released, the moveable holding member is moved by the at least one spring to secure the grooming tool.

2. The personal grooming device extender according to claim 1, wherein the arm is configured to adjust and lock into at least four positions at angles between about 0 degrees and about 90 degrees.

3. The personal grooming device extender according to claim 1, wherein the arm is coupled with the distal end of the telescoping handle via a hinge having hinge pins on opposing sides thereof.

4. The personal grooming device extender according to claim 1, wherein the telescoping handle is configured to telescope from a first position to three or more extended positions.

5. The personal grooming device extender according to claim 1, further comprising a wrist strap coupled onto the proximal end of the handle.

6. The personal grooming device extender according to claim 1, wherein the handle comprises a plurality of grips positioned along the bottom side.

7. The personal grooming device extender according to claim 1, wherein the handle further comprises a rubber coating there around.

8. The personal grooming device extender according to claim 1, wherein the handle comprises an inner sleeve and an outer sleeve, wherein the outer sleeve is slideably coupled onto the inner sleeve.

9. The personal grooming device extender according to claim 8, wherein the inner sleeve comprises a top slide track having a plurality of locking positions, and wherein the outer sleeve comprises a button for locking the outer sleeve into one of the plurality of locking positions.

10. A personal grooming apparatus, comprising:

a telescoping handle having a proximal end and a distal end, and a top side and a bottom side; wherein the telescoping handle is configured to telescope from a first position to a plurality of extended positions;

an arm pivotably coupled with the distal end of the telescoping handle, the arm configured to adjust to a plurality of positions between a first position, extended linearly from the handle and a second position perpendicular with the distal end of the handle; and a receiver releasably coupled onto the arm, the receiver comprising a moveable holding member configured to receive and hold a grooming tool, wherein at least a portion of the moveable holding member extends externally from the receiver;

wherein the moveable holding member is spring-loaded by at least one spring;

wherein the portion of the moveable holding member that extends externally is configured to be pressed to compress the at least one spring for creating a wide opening for receiving the grooming tool and when the portion is released, the moveable holding member is moved by the at least one spring to secure the grooming tool.

11. The personal grooming apparatus according to claim 10, wherein the arm is configured to adjust and lock into at least four positions at angles between about 0 degrees and about 90 degrees.

12. The personal grooming apparatus according to claim 10, further comprising a wrist strap coupled onto the proximal end of the handle.

13. The personal grooming apparatus according to claim 10, wherein the handle comprises a plurality of grips positioned along the bottom side.

14. The personal grooming apparatus according to claim 10, wherein the handle further comprises a rubber coating there around.

15. The personal grooming apparatus according to claim 10, wherein the handle comprises an inner sleeve positioned within an outer sleeve, wherein the inner sleeve comprises a track along the bottom side having a plurality of locking positions, and wherein the outer sleeve comprises a button for locking the outer sleeve into one of the plurality of locking positions.

16. The personal grooming device extender according to claim 10, wherein an inner sleeve comprises a track along a top side having a plurality of locking positions, and wherein an outer sleeve comprises a button for locking the outer sleeve into one of the plurality of locking positions.

17. A personal grooming system, comprising:

a telescoping handle, the telescoping handle comprising:

a proximal end and a distal end;

a top side and a bottom side;

an inner sleeve; and an outer sleeve slideably fitted over the inner sleeve;

wherein the telescoping handle is configured to telescope from a first position to a plurality of extended positions;

an arm pivotably coupled with the distal end of the telescoping handle, the arm configured to adjust to a plurality of positions between a first position, extended linearly from the handle and a second position perpendicular with the distal end of the handle; and a receiver releasably coupled onto the arm, the receiver comprising a spring-loaded moveable holding member configured to receive and hold a grooming tool, wherein at least a portion of the moveable holding member extends externally from the receiver;

wherein the movable holding member is spring-loaded by at least one spring;

wherein the portion of the moveable holding member that extends externally is configured to be pressed to compress the at least one spring for creating a wide opening for receiving the grooming tool and when the portion is released, the moveable holding member is moved by the at least one spring to secure the grooming tool.

* * * * *